US009737821B1

(12) United States Patent
Horikoshi

(10) Patent No.: US 9,737,821 B1
(45) Date of Patent: Aug. 22, 2017

(54) TOY TOP

(71) Applicant: TOMY COMPANY, LTD., Tokyo (JP)

(72) Inventor: Kenji Horikoshi, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/427,476

(22) Filed: Feb. 8, 2017

(30) Foreign Application Priority Data

Jul. 12, 2016 (JP) ..... 2016-137398

(51) Int. Cl.
*A63H 1/02* (2006.01)
*A63H 1/18* (2006.01)

(52) U.S. Cl.
CPC ..... *A63H 1/02* (2013.01); *A63H 1/18* (2013.01)

(58) Field of Classification Search
CPC ... A63H 1/00; A63H 1/02; A63H 1/04; A63H 1/18
See application file for complete search history.

(56) References Cited

U.S. PATENT DOCUMENTS 7,063,589 B2 6/2006 Matsukawa et al.
7,427,225 B2 9/2008 Matsukawa et al.
8,066,543 B2 11/2011 Kitamura et al.
9,101,845 B2 * 8/2015 Cai ..... A63H 1/18
2011/0177750 A1 7/2011 Ujita et al.

FOREIGN PATENT DOCUMENTS

JP 3071356 8/2000
JP 3098449 3/2004
JP 3160157 6/2010
JP 5793631 10/2015

OTHER PUBLICATIONS

Notice of Allowance for JP 2016-137398, issued Feb. 28, 2017.
Espacenet English Abstract of Japanese Publication No. 3160157, published Jun. 17, 2010.
Espacenet English Abstract of Japanese Publication No. 5793631, published Oct. 14, 2015.

* cited by examiner

*Primary Examiner* — John Ricci
(74) *Attorney, Agent, or Firm* — Staas & Halsey LLP

(57) ABSTRACT

A toy top includes a shaft unit and a body into which a slot to which a fork of a launcher is to be inserted is formed concentrically with a shaft axis. The body includes a lock receiver which is disposed in an end of a slot, and which is to be locked by a locking part of the fork to be inserted into the slot. A spinning force is applied by rotation of the fork of the launcher in a state in which the fork is slid inside the slot toward the end beforehand so that the lock receiver is locked by the locking part at a previously-set locking position. Locking positions are defined respectively at opposite ends of the slot. The lock receiver is movable to and from the locking positions.

7 Claims, 8 Drawing Sheets

TOY TOP

BACKGROUND OF THE INVENTION

1. Field of the Invention

The present invention relates to a toy top.

2. Description of Related Art

A toy top set has been known in the art that includes a toy top only for clockwise spin, a toy top only for anticlockwise spin and a spinning machine (launcher) with a launcher for spinning the toy tops in the clockwise and anticlockwise directions (e.g. see Japanese Utility Model No. 3071356).

In the toy top set, each of the toy top only for clockwise spin and the toy top only for anticlockwise spin is configured such that a body and a shaft unit are detachable from each other, and it is therefore possible to invert the clockwise or anticlockwise spinning direction by exchanging the respective bodies with each other.

When applying a spinning force to a toy top by using a launcher, it is required to hold the toy top so that it does not come off from the launcher.

To achieve this, in the prior art for example, an arc slit into which a fork of the launcher is inserted is formed in the body concentrically with the shaft axis, and a lock receiver to be locked by a hook (locking part) of the fork inserted in a slot is provided in an end in the longitudinal direction of the arc slit. In more detail, the width of the arc slit is narrowed only at one end in the longitudinal direction. To engage the locking part with the lock receiver, the hook of the fork is moved relative to the arc slit from the wide side to the narrow side and is slid under the edge (lock receiver) of the arc slit. The toy top is thus prevented from coming off from the launcher. After a spinning force is applied to the toy top by means of rotation of the fork of the launcher in this state, the rotation of the fork is stopped so that the hook of the fork is moved relative to the arc slit from the narrow side to the wide side by the internal force of the toy top. The engagement of the locking part with the lock receiver is thus unlocked, and the toy top is launched from the launcher.

However, when the width of the arc slit is narrowed only at one end in the longitudinal direction as described above, such configuration uniquely determines the spinning direction by the launcher. Therefore, there has been no option but to provide a toy top only for clockwise spin and a toy top only for anticlockwise spin.

As a result, in order to change the spinning direction of a toy top, it has been required to own both of a toy top only for clockwise spin and a toy top only for anticlockwise spin as in Japanese Utility Model No. 3071356 or to own a toy top and an additional body for a spinning direction different from that of the toy top.

SUMMARY OF THE INVENTION

The present invention has been made in view of the problem, and an object thereof is to provide a toy top with a spinning direction that can be changed without replacing a part.

In order to realize the above object, according to one aspect of the present invention, there is provided a toy top, including:

a shaft unit; and a body into which a slot to which a fork of a launcher is to be inserted is formed concentrically with a shaft axis, wherein the body comprises a lock receiver which is disposed in an end in a longitudinal direction of the slot, and which is to be locked by a locking part of the fork to be inserted into the slot, wherein the toy top is configured such that a spinning force is applied by means of rotation of the fork of the launcher in a state in which the fork is slid inside the slot toward the end beforehand so that the lock receiver is locked by the locking part at a previously-set locking position, wherein the toy top is launched from the launcher when rotation of the fork is stopped so that the lock receiver is unlocked from the locking part, wherein locking positions are defined respectively at opposite ends in the longitudinal direction of the slot, and wherein the lock receiver is movable to and from the locking positions and is able to selectively enter one of the locking positions.

This configuration enables locking the lock receiver by the locking part at either one of the opposite ends in the longitudinal direction of the slot according to a desired spinning direction of the toy top. As a result, it is possible to change the spinning direction without exchanging a part.

Preferably, the lock receiver is slidable between the opposite ends in the longitudinal direction of the slot.

This configuration enables changing the spinning direction of the toy top without replacing a part by sliding the lock receiver along the slot between opposite ends thereof.

Preferably, a plurality of slots are formed in the body at a predetermined interval in a circumferential direction of the body, and the lock receiver comprises a plurality of lock receivers which are disposed in the respective plurality of slots.

Since the plurality of lock receivers are locked by the locking part, the toy top is reliably loaded to the launcher.

Preferably, an even number of slots are formed such that every one of the slots is opposed to another slot across the shaft axis.

Since an even number of the slots are formed such that every one of the slots is opposed to another slot across the shaft axis, the toy top is loaded to the launcher in a good balance.

Preferably, two slots are formed in the body, and the lock receiver comprises two lock receivers which are disposed respectively in the two slots and which are coupled to each other by a lock receiver support.

Since the two lock receivers are coupled to each other by the lock receiver support, the spinning direction is readily switched.

Preferably, the shaft unit is disposed under the body, the body comprises a first hook, the shaft unit comprises a second hook, and a state of the body and the shaft unit is changeable between a coupled state and a decoupled state according to a relative rotational position about the axis of the shaft unit, in which the first hook is aligned with the second hook in an up-down direction such that an upper face of the first hook is opposed to an under face of the second hook in the coupled state, and the first hook is not aligned with the second hook in the up-down direction in the decoupled state, the state is set from the decoupled state to the coupled state by turning the shaft unit relative to the body in a predetermined rotational direction, and when the spinning toy top is subjected to an impact that rotates the shaft unit relative to the body in an opposite direction to the predetermined rotational direction to change the state to the decoupled state, the body and the shaft are decoupled from each other and disassembled.

In this configuration, toy tops for a battle game that spin in different directions can be achieved by the single toy top.

Preferably, the body and the shaft unit comprise respective opposing portions that are opposed to each other, and the opposing portions of the body and the shaft unit comprise a resistance that makes slidable contact between the opposing portions so as to allow stepwise rotation of the shaft unit relative to the body from a first position in the coupled state to a second position in the decoupled state.

Since the shaft unit can be rotated relative to the body in a stepwise manner, a battle time until the toy top is disassembled is extended.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Hereinafter, an embodiment of a toy top according to the present invention will be described with reference to the drawings. Though various technical limitations which are preferable to perform the present invention are included in the after-mentioned embodiment, the scope of the invention is not limited to the following embodiment and the illustrated examples.

General Configuration

Figure 1:
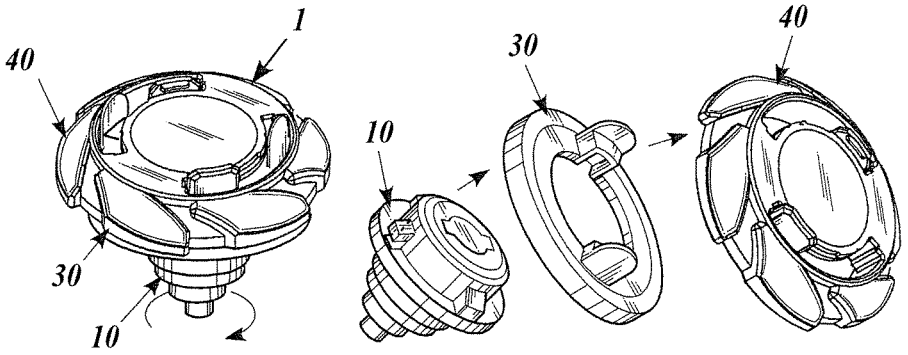
FIG. 1 illustrates how to play a toy top according to an embodiment of the present invention.
Figure 2:
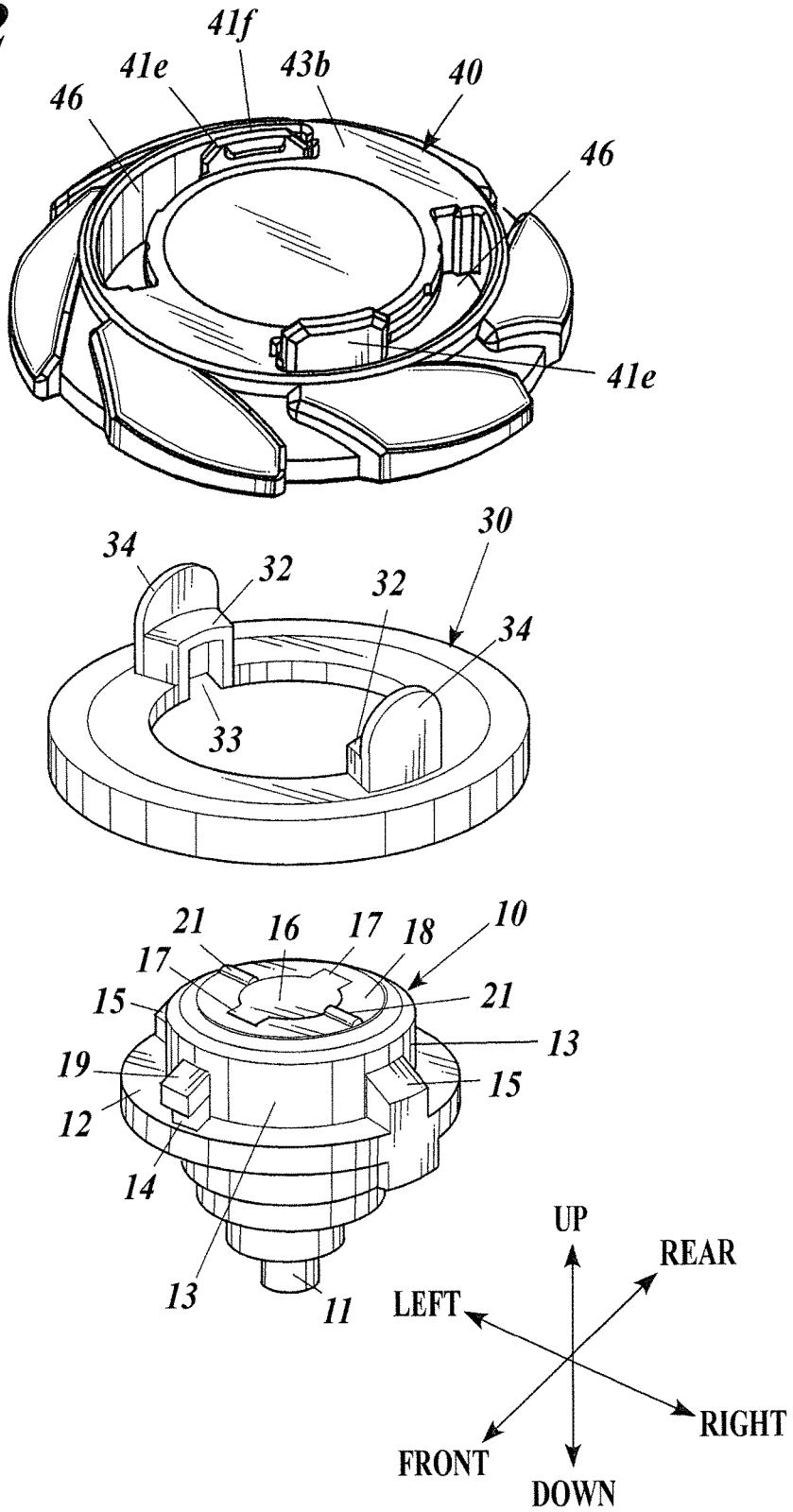
FIG. 2 is an exploded perspective view of the toy top according to the embodiment.
Figure 3:
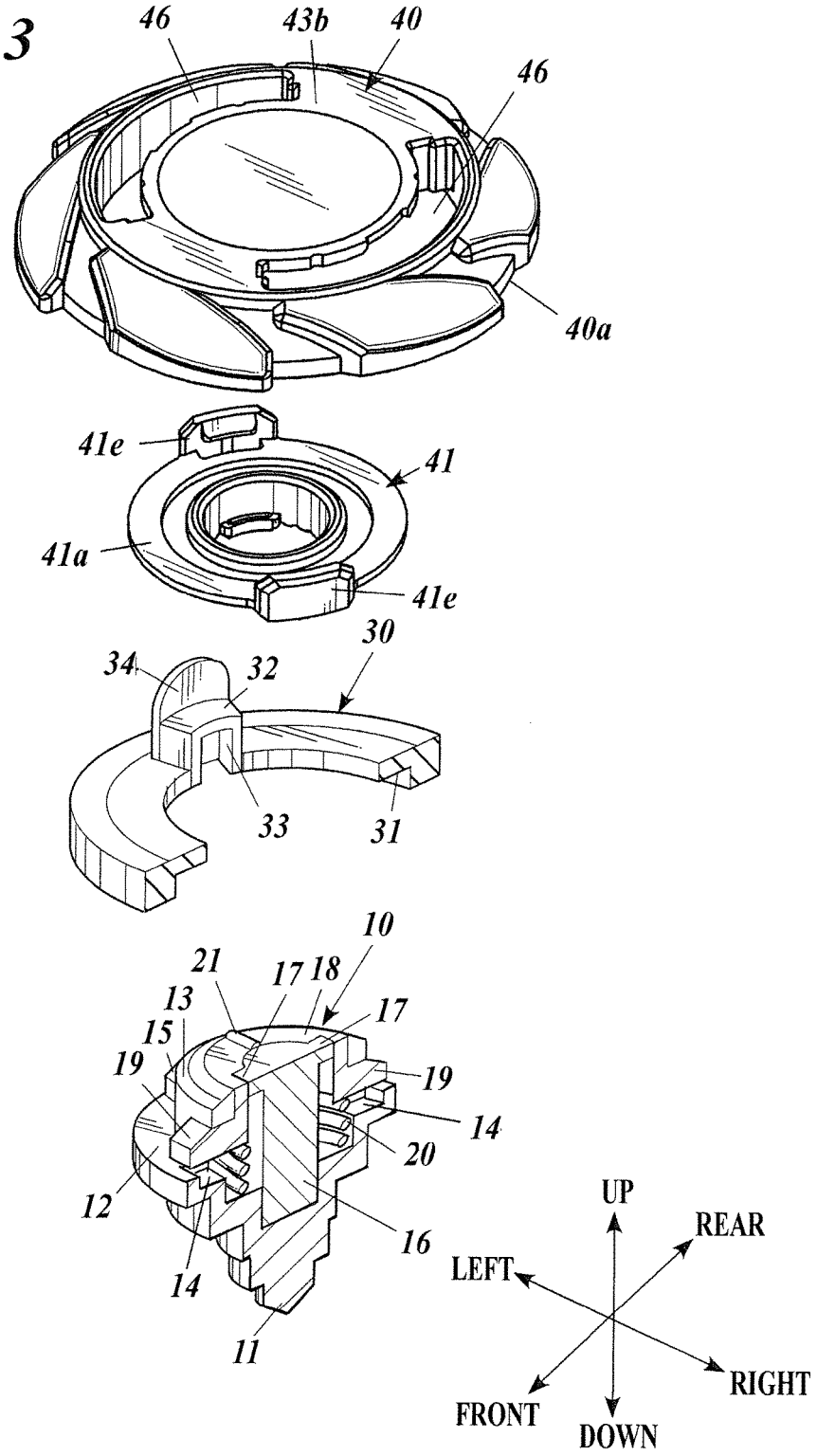
FIG. 3 is an exploded perspective view of the toy top according to the embodiment, which also illustrates cross sections of some parts.

FIG. 1 illustrates how to play a toy top according to the embodiment of the present invention, FIG. 2 is an exploded perspective view of the toy top according to the embodiment, and FIG. 3 is an exploded perspective view of the toy top according to the embodiment, which also illustrates cross sections of some parts. As used herein, the terms up-down, right-left and front-rear represent the respective directions as illustrated in FIG. 2 and FIG. 3.

The toy top 1 of the embodiment is of a type that can be used in a so-called "top battle game". Specifically, the toy top 1 can be used in a top battle game in which a player wins the game when an opponent toy top 1 is disassembled as illustrated in the right part of FIG. 1 by the impact force of a collision between toy tops.

As illustrated in FIG. 2 and FIG. 3, the toy top 1 is composed of a shaft unit 10 as the lower structure, and a performance changing ring 30 and a body 40 as the upper structure.

Figure 6A:
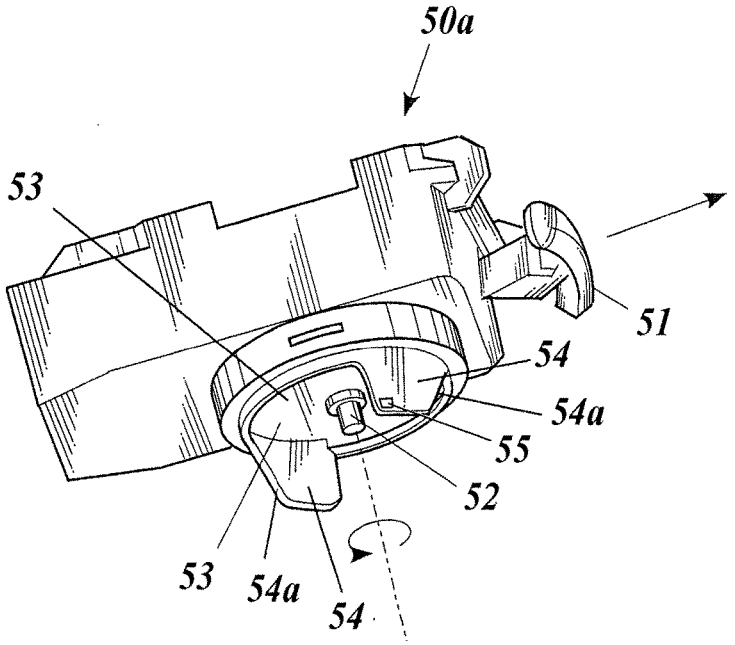
FIG. 6A is a perspective view of the launcher according to the embodiment as seen from below.
Figure 6B:
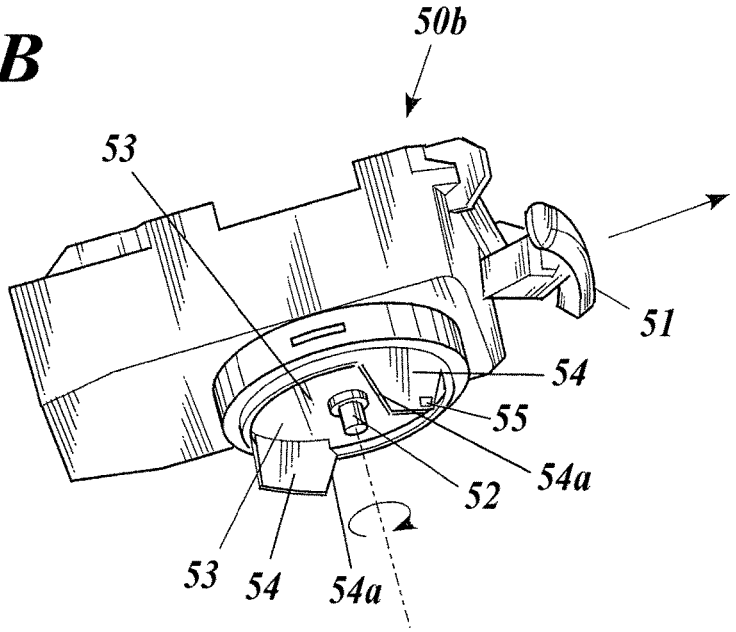
FIG. 6B is a perspective view of a launcher according to the embodiment as seen from below, which rotates in a different direction from the launcher of FIG. 6A.

A launcher 50*a* or 50*b* as illustrated in FIG. 6A and FIG. 6B applies a spinning force in the clockwise or anticlockwise direction in a plan view to the toy top 1 and releases it to a battle field. The launcher 50*a* is configured to apply a clockwise spinning force to the toy top 1, and the launcher 50*b* is configured to apply an anticlockwise spinning force to the toy top 1.

In the toy top 1 according to the embodiment, it is possible to change the spinning direction by an operation on a predetermined part without replacing a part of the toy top 1.

Detailed Configuration

1. Shaft Unit 10

The shaft unit 10 includes a spinning shaft 11 in the lower part, a flange 12 in the middle part and a cylinder 13 in the upper part. The spinning shaft 11, flange 12 and cylinder 13 are made of synthetic resin. However, the material is not limited to synthetic resin, and at least one or all of them may be made of metal or rubber.

The lower part of the flange 12 narrows stepwise from the flange 12 toward the outer periphery of the spinning shaft 11 and is formed in an approximately inverted conical shape as a whole.

As illustrated in FIG. 2, two holes 14 are formed in the flange 12 and the cylinder 13, which are mutually opposed in the front-rear direction across the axis of the spinning shaft 11. Further, two protrusions 15 are formed in the cylinder 13 and the lower part of the flange 12 which are mutually opposed in the left-right direction across the axis of the spinning shaft 11. The outer faces of the protrusions 15 are flush with the outer peripheral face of the flange 12.

As illustrated in FIG. 3, a cylindrical pillar 16 stands inside the cylinder 13. The upper end of the cylindrical pillar 16 is located higher than the upper end of the cylinder 13, although it is not limited thereto. In the upper end of the cylindrical pillar 16, two hooks (second hooks) 17 are formed which are mutually opposed in the front-rear direction across the axis of the spinning shaft 11 and protrude outward in their respective radial directions.

The shaft unit 10 includes a cylindrical movable member 18 that is disposed inside the cylinder 13 and surrounds the upper outer periphery of the cylindrical pillar 16. In the lower end of the outer peripheral face of the movable member 18, two protrusions 19 are formed which are mutually opposed in the front-rear direction across the axis of the spinning shaft 11 and protrude outward in their respective radial directions. The protrusions 19 are inserted in the holes 14. The movable member 18 is movable in the up-down direction, but the upper edges of the holes 14 limit the upward movement of the movable member 18. The movable member 18 is biased upward by means of a coil spring 20 that is wound around the cylindrical pillar 16. In a normal state, the protrusions 19 are in contact with the upper edges of the holes 14, and the upper end of the movable member 18 is located at the substantially same height as the upper end of the cylindrical pillar 16.

On the upper face of the movable member 18, two ridges 21 are formed which are mutually opposed in the right-left direction across the axis of the spinning shaft 11 and extend in their respective radial directions.

2. Performance Changing Ring 30

In the embodiment, the performance changing ring 30 is constituted by a flywheel made of, for example, metal. The performance changing ring 30 has a plate shape. On the bottom face of the performance changing ring 30, an annular step 31 is formed which can house the flange 12 of the shaft unit 10 from the lower side. Further, on the upper face of the performance changing ring 30, two protrusions 32 each having a shape like a turned "U" are formed. The protrusions 32 are mutually opposed in the right-left direction across the axis of the spinning shaft and protrude upward. On the lower parts of the protrusions 32, recesses 33 are respectively formed which can house the protrusions 15 of the shaft unit 10 from the lower side. Further, on the upper face of the performance changing ring 30, tongues 34 are formed which extend upward along the outer side of the respective protrusions 32. The tongues 34 protrude higher than the protrusions 32. Alternatively, the performance changing ring 30 may be constituted by a member that includes a protrusion on the outer peripheral face for facilitating an attack on an opponent toy top 1 or a member that includes a recess on the outer peripheral face for averting an attack from the opponent toy top 1. Such a member may be provided instead of or integrally with a flywheel.

3. Body 40

The body 40 has a disk shape. As illustrated in FIG. 2, a spinning direction switching member 41 is attached to the body 40.

In the outer periphery of the body 40, an uneven pattern 40*a* is formed. In the top wall 43*b* of the body 40, arc slits 46 are formed, in which the tongues 34 of the performance changing ring 30 can be inserted from below. The arc slits 46 have a concentric shape with the spinning shaft 11. The arc slits 46 has such a length that allows the tongues 34 to move adequately.

Figure 4:
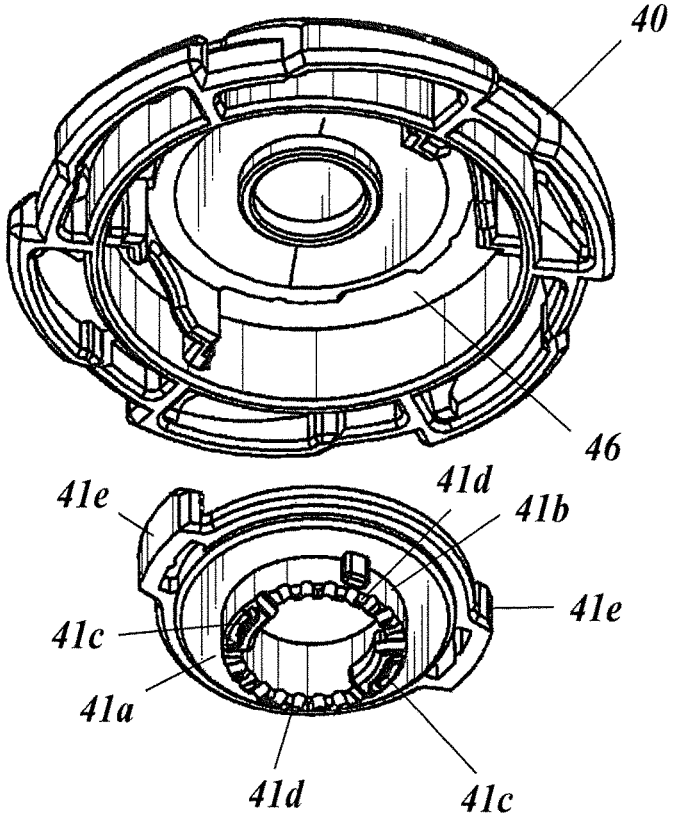
FIG. 4 is an exploded perspective view of a body and a spinning direction switching member according to the embodiment as seen from below.

The spinning direction switching member 41 is formed in an approximately circular shape in a plan view. The spinning direction switching member 41 is attached concentrically with the body 40. As illustrated in FIG. 3 and FIG. 4, the spinning direction switching member 41 includes a disk-shaped lock receiver support 41*a*. From the lock receiver support 41*a*, a cylinder 41*b* protrudes downward. On the lower end of the internal circumference of the cylinder 41*b*, two hooks (first hooks) 41*c* are disposed which are mutually opposed across the axis of the spinning shaft 11 and protrude inward in their respective radial directions. The hooks 41*c* can engage with the above-described hooks (second hooks) 17. Further, on the lower end face of the cylinder 41*b*, grooves 41*d* are formed which extend radially at predetermined intervals in two locations mutually opposed across the axis of the spinning shaft 11. The grooves 41*d* are continuously formed between the two hooks 41*c*. Further, on the lock receiver support 41*a*, standing parts 41*e* that overhang outward in the radial direction are formed at two locations mutually opposed across the axis of the spinning shaft 11. On the internal circumference of the standing parts 41*e*, lock receiver 41*f* are formed in a hook shape.

Figure 5:
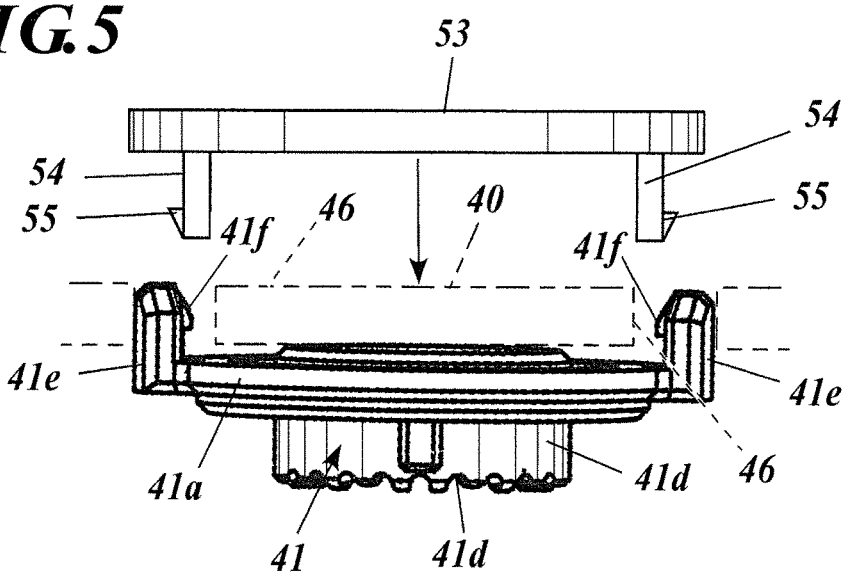
FIG. 5 illustrates the engagement between a launcher and the spinning direction switching member according to the embodiment.

As illustrated in FIG. 5, the outer circumferences of the standing parts 41*e* are tightly fitted with the outer peripheral edges of the arc slits 46 from below. In the fitted state, gaps are formed between the hooks 41*c* of the standing parts 41*e* and the inner peripheral edges of the arc slits 46, which can receive the fork 54 of the launcher 50*a*, 50*b* (see FIG. 6A and FIG. 6B). The lock receivers 41*f* can engage with the hooks (locking parts) 55 of the launcher 50*a*, 50*b*. Regarding the shape, the lock receiver 41*f* is configured such that when the top holder 53 of the launcher 50*a*, 50*b* is rotated relative to the spinning direction switching member 41, the lock receiver 41*f* can engage with the hook 55 regardless of the direction of the relative rotation. It is preferred that the lock receivers 41*f* can be fixedly held at either end in the longitudinal direction of the arc slits 46 during engagement or disengagement between the lock receivers 41*f* and the hooks 55. Instead of the tight fitting of the outer circumferences of the standing parts 41*e* with the outer peripheral edges of the arc slits 46 from below, the lock receivers 41*f* may be fixedly held at the same position by means of fitting of a protrusion and a recess, engagement of a hook, magnetic attachment or the like.

4. Launcher 50*a*, 50*b*

The launcher 50*a*, 50*b* as illustrated in FIG. 6A and FIG. 6B is used for charging a spinning force to the toy top 1. The toy top 1 is loaded to launcher 50*a*, 50*b*. That is, the fork 54 is inserted into the arc slits 46 of the body 40. Then, the hooks 55 of the fork 54 are locked with the lock receiver 41*f* of the spinning direction switching member 41. The toy top 1 is thus loaded to the launcher 50*a*, 50*b*.

The launcher 50*a*, 50*b* includes a disk (not shown) therein and is configured such that when a string (not shown) wound around the disk is pulled by means of a handle 51 while a spiral spring biases the disk in a certain rotational direction, the disk is rotated, and a top holder 53 is rotated accordingly. The rotation of the top holder 53 is transmitted to the toy top 1 through the fork 54 that protrudes downward, so as to spin the toy top 1.

Then, when the handle 51 of the launcher 50*a*, 50*b* is completely pulled, the disk and the top holder 53 stop rotating while the toy top 1 continues spinning by the action of its inertial force. Accordingly, the toy top 1 follows tilted faces 54*a* of the fork 54 and comes off from the top holder 53.

In FIG. 6A and FIG. 6B, the reference sign 52 denotes a rod that is retractable into the top holder 53. When the toy top 1 is loaded to the top holder 53, the rod 52 is pushed in the top holder 53 by the upper face of the toy top 1. For example, the rod 52 is used for detecting attachment/detachment of the toy top 1.

5. Positional Relationship Between Body 40, Spinning Direction Switching Member 41 and Shaft Unit 10

Figure 7:
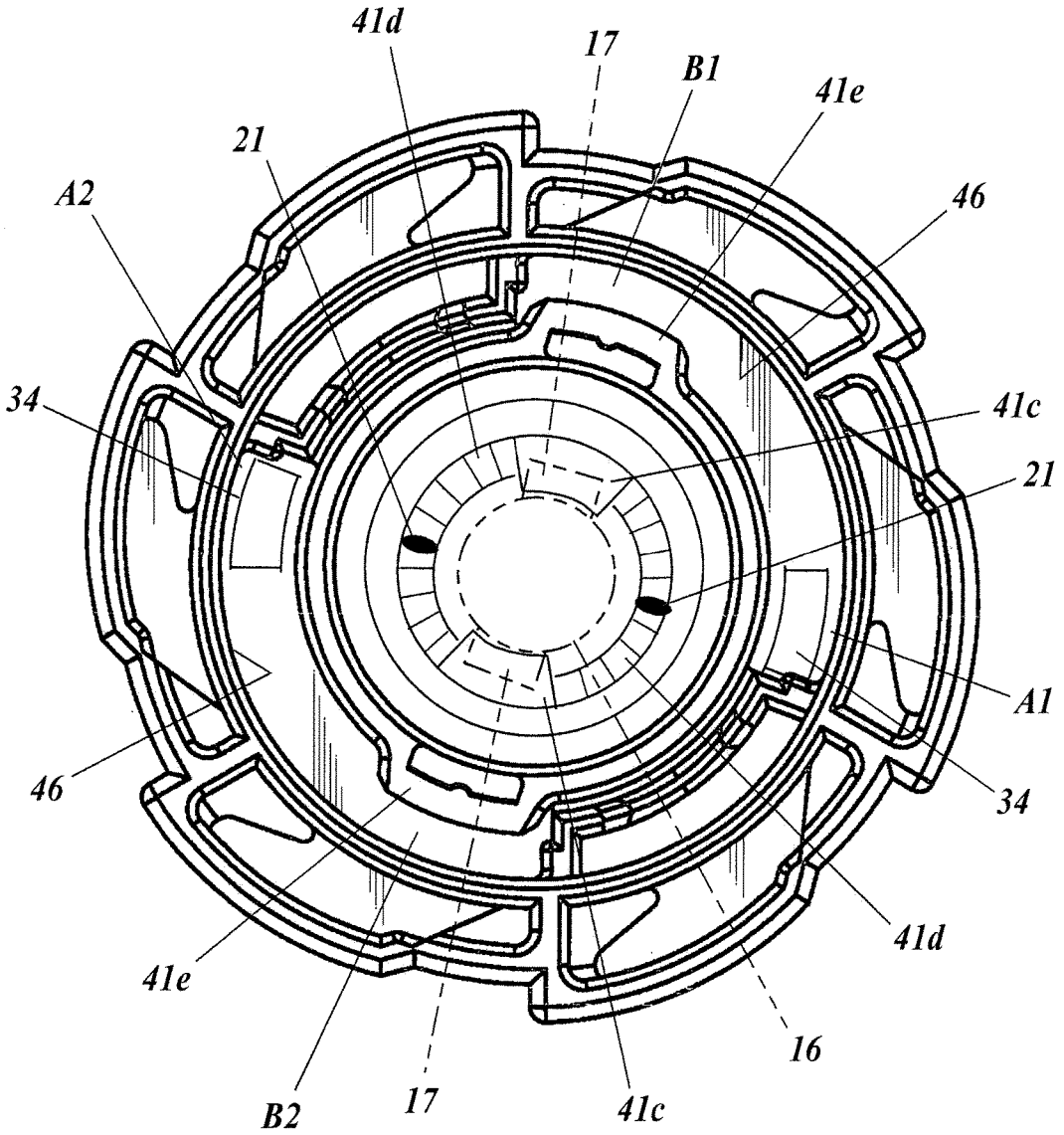
FIG. 7 is a bottom view of the body, the spinning direction switching member and a shaft unit of the embodiment, illustrating the positional relationship thereof.

FIG. 7 is a bottom view of the toy top 1, illustrating the positional relationship between the body 40, the spinning direction switching member 41 and the shaft unit 10 when the toy top 1 is spun in the clockwise direction. In the toy top 1 in this state, the tongues 34, 34 of the performance changing ring 30 are respectively located at one end of the two arc slits 46, i.e. positions A1, and A2. Further, the standing parts 41*e*, 41*e* of the spinning direction switching member 41 are located respectively at the other end of the two arc slits 46, i.e. positions B1, B2. The hooks 41*c*, 41*c* of the spinning direction switching member 41 are aligned and coupled with the hooks 17, 17 of the cylindrical pillar 16 in the up-down direction. The grooves 41*d* of the spinning direction switching member 41 are engaged with the ridges 21 of the movable member 18 at the midpoint between the hooks 41*c*, 41*c* of the spinning direction switching member 41.

Figure 8:
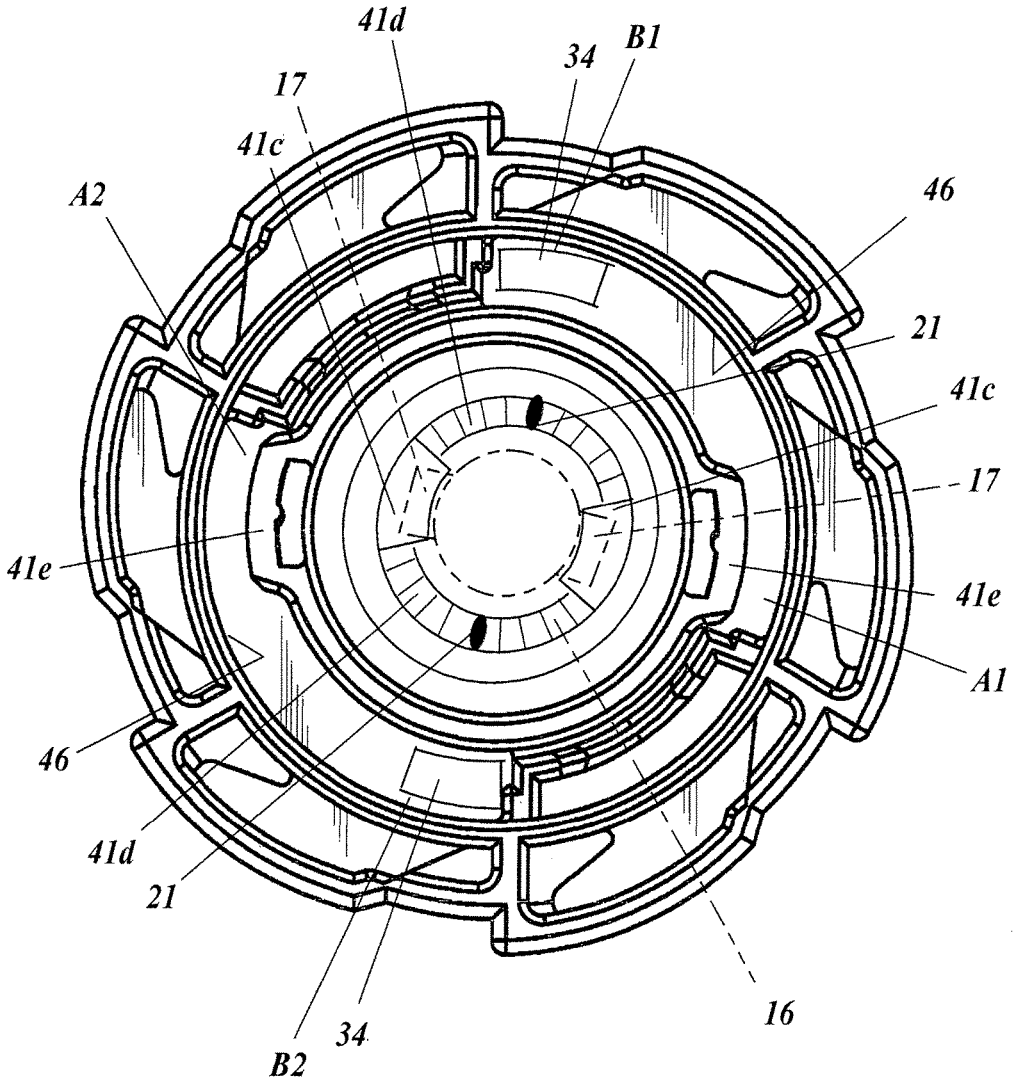
FIG. 8 is a bottom view of the body, the spinning direction switching member and a shaft unit of the embodiment, illustrating the positional relationship thereof.

FIG. 8 is a bottom view of the toy top 1, illustrating the positional relationship between the body 40, the spinning direction switching member 41 and the shaft unit 10 when the toy top 1 is spun in the anticlockwise direction. In the toy top 1 in this state, the standing parts 41*e*, 41*e* of the spinning direction switching member 41 are located respectively at one end of the two arc slits 46, i.e. the positions A1, and A2. Further, the tongues 34, 34 of the performance changing ring 30 are located respectively at the other end of the two arc slits 46, i.e. the positions B1, B2. The hooks 41*c*, 41*c* of the spinning direction switching member 41 are aligned and coupled with the hooks 17, 17 of the cylindrical pillar 16 in the up-down direction. The grooves 41*d* of the spinning direction switching member 41 are engaged with the ridges 21 of the movable member 18 at the midpoint between the hooks 41*c*, 41*c* of the spinning direction switching member 41.

Assembling Method

Next, an example of the assembling method of the toy top 1 will be described.

First, the standing parts 41*e* of the spinning direction switching member 41 attached to the body 40 is slid inside the arc slits 46 in the direction corresponding to a desired spinning direction of the toy top 1. The sliding movement is achieved by a manual operation of moving the spinning direction switching member 41 directly by hand or by using a jig that meshes with the grooves 41*d* of the spinning direction switching member 41. Next, the shaft unit 10 is fitted in the performance changing ring 30 from the lower side such that the protrusions 15 of the shaft unit 10 mate with the recesses 33 of the performance changing ring 30. Subsequently, the assembly is brought toward the body 40 from the lower side. In this step, the tongues 34 of the performance changing ring 30 of the assembly are positioned in the spinning direction switching member 41 of the arc slit 46 of the body 40 at the side with the standing parts 41*e*. In this state, the hooks 17 of the shaft unit 10 do not overlap the hooks 41*f* of the spinning direction switching member 41 in the vertical direction. This state is referred to as a decoupled state. Thereafter, the shaft unit 10 of the assembly is pushed toward the body 40. Then the performance changing ring 30 firstly abuts the bottom face of the body 40. When the shaft unit 10 of the assembly is pushed further toward the body 40, the protrusions 19 of the shaft unit 10 are pushed down by the bottom face of the performance changing ring 30 against the biasing force of the coil spring 20. In this state, the hooks 17 of the shaft unit 10 are higher than the hooks 41*f* of the spinning direction switching member 41. Then, the shaft unit 10 together with the performance changing ring 30 is turned relative to the body 40 in the direction in which the tongues 34 gets away from the standing parts 41*e* of the spinning direction switching member 41. This turn is a relative turn between the assembly of the body 40 and the performance changing ring 30 and the shaft unit 10. FIG. 7 and FIG. 8 illustrate a state in which the body 40 has been already turned relative to the shaft unit 10 and the performance changing ring 30. This state is referred to as a coupling state. Thus the shaft unit 10, the performance changing ring 30 and the body 40 are coupled with one another. The toy top 1 is thus assembled.

How to Play

Next, an example of how to play the toy top 1 will be described.

In this example, a player spins a toy top 1 to battle with an opponent toy top 1.

In such cases, the launcher 50*a*, 50*b* is used to apply a rotary force to the toy top 1. After the rotary force is applied by the launcher 50*a*, 50*b*, the toy top 1 is launched and is led to a predetermined battle field where it spins. When the body 40 collides with the opponent toy top 1, an impact, a friction and the like caused by the collision act to stop the body 40. Meanwhile, the shaft unit 10 and the performance changing ring 30 keep spinning, and the body 40 therefore turns relative to the shaft unit 10 and the performance changing ring 30 in the opposite direction to the rotational direction thereof.

Then, the ridges 21 of the shaft unit 10 engage with the grooves 41*d* of the body 40 one after another and are successively held in the respective positions. When the hooks 41*c* of the body 40 are released from the hooks 17 of the shaft unit 10, the body 40 is separated from the shaft unit 10 by the action of the biasing force of the spring 20. Accordingly, the toy top 1 is disassembled as illustrated in the right part of FIG. 1.

Figure 9:
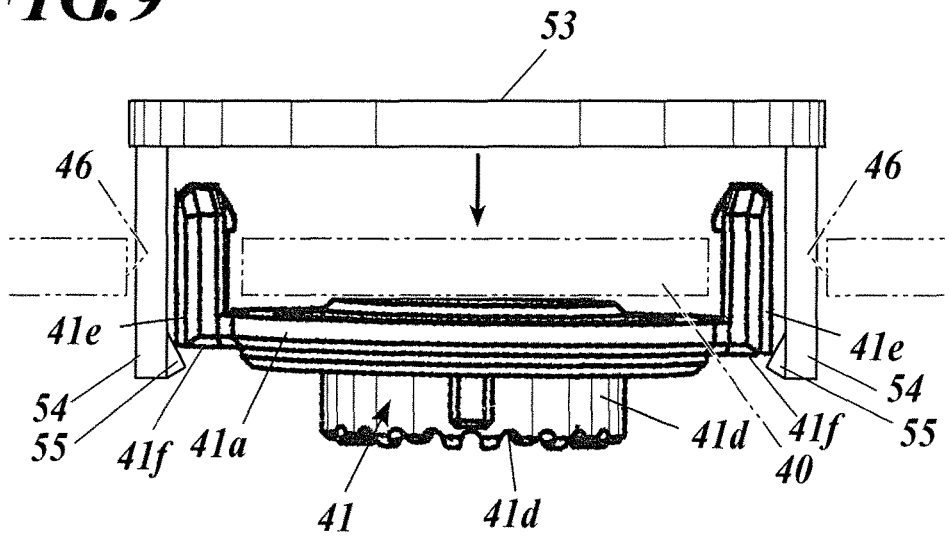
FIG. 9 illustrates the engagement between a launcher and the spinning direction switching member according to another embodiment.

FIG. 9 illustrates the engagement between a launcher and the spinning direction switching member according to another embodiment.

In this embodiment, the lock receivers 41*f* are formed on the bottom of the standing parts 41*e*. The hooks 55 are formed on the internal circumference of the fork 54 of the launcher 50*a*, 50*b*.

As illustrated in FIG. 9, the internal circumferences of the standing parts 41*e* are tightly fitted with the inner peripheral edges of the arc slits 46 from below. In the fitted state, gaps are formed between the standing parts 41*e* and the outer peripheral edges of the arc slits 46, which can receive the fork 54 of the launcher 50*a*, 50*b* (see FIG. 6A and FIG. 6B). The lock receivers 41*f* can engage with the hooks 55 of the launcher 50*a*, 50*b*. Regarding the shape, the lock receiver 41*f* is configured such that when the top holder 53 of the launcher 50*a*, 50*b* is rotated relative to the spinning direction switching member 41, the lock receiver 41*f* can engage with the hook 55 regardless of the direction of the relative rotation. It is preferred that the lock receivers 41*f* can be fixedly held at either end in the longitudinal direction of the arc slits 46 during engagement or disengagement between the lock receivers 41*f* and the hooks 55. Instead of the tight fitting of the internal circumferences of the standing parts 41*e* with the inner peripheral edges of the arc slits 46 from below, the lock receivers 41*f* may be fixedly held at the same position by means of fitting of a protrusion and a recess, engagement of a hook, magnetic attachment or the like.

Variations of the Present Invention

While an embodiment of the present invention is described, the present invention is not limited to the embodiment, and various changes may be made without departing from the spirit of the present invention.

For example, in the above-described embodiment, the ridges 21 and the grooves 41*d* are formed respectively in the shaft unit 10 and the spinning direction switching member 41 as a rotational resistance between the shaft unit 10 and the body 40. Instead, the rotational resistance may be constituted by protrusions and recesses with different shapes. Further, the number of ridges or grooves is not limited to that in the above-described embodiment. Alternatively, the rotational resistance may be constituted by a rubber or the like formed in the opposed faces of the shaft unit 10 and the spinning direction switching member 41.

In the above-described embodiment, the ridges 21 of the shaft unit 10 are opposed to the grooves 41*d* of the spinning direction switching member 41 in the up-down direction. Instead, they may be opposed in the radial direction.

In the above-described embodiment, the two lock receivers 41*f*, 41*f* are integrally coupled with each other by the lock receiver support 41*a*. Instead, the two lock receivers 41*f*, 41*f* may be individually disposed in the body 40 as separate members.

The above-described embodiment illustrates the toy top 1 for the battle game. However, the present invention is not limited thereto. The present invention is generally applicable to toy tops to which a spinning force is applied in the clockwise or anticlockwise direction in the plan view by using a launcher 50*a*, 50*b*. In such cases, unlike the arc slits 46, the holes do not necessarily penetrate the top wall 43*b* of the body 40 in the up-down direction.

In the above-described embodiment, the locking parts 55 and the lock receivers 41*f* are formed in a hook shape. However, they may be formed in any shape as long as they can engage in the longitudinal direction of the arc slits 46, prevent the toy top 1 from coming off from the launcher 50*a*, 50*b* and disengage after a spinning force is charged. For example, they may be configured to fit with each other by a protrusion and a recess or to engage with each other by a magnetic force.

In the above-described embodiment, the lock receivers 41*f* are disposed in the arc slits 46 to which the tongues 34 of the performance changing ring 30 can be inserted from below. Instead, independent arc slits may be formed individually for the performance changing ring and the lock receivers 41*f*. Further, the lock receivers 41*f* may be provided in recesses that do not penetrate the body 40 in the up-down direction. As used herein, the term "slot" shall include a slit and a recess.

In the above-described embodiment, the lock receivers 41*f* are configured to be slidable between opposite ends in the longitudinal direction of the arc slits 46 so that they can be moved to and from the locking positions at the ends in the longitudinal direction of the arc slits 46. Instead, the lock receivers 41*f* may be originally provided respectively at both ends in the longitudinal direction of the arc slits 46 and configured to be retractable (projectable) into (from) the arc slits by a manual operation. The movement of the lock receivers 41*f* in this case may be linear reciprocating movement, rotational movement or reciprocating rotational movement.

Further, in this case, the lock receiver support 41*a* may be rotatable about a predetermined axis, and the lock receiver support 41*a* may be biased by means of a spring in a direction in which the lock receivers 41*f* retract into the arc slits 46. Thus, the lock receivers 41*f* may be configured to protrude into the arc slits 46 by an abutment of the fork 54 with the lock receiver support 41*a* when the fork 54 is moved in the arc slits 46 toward the lock receivers 41*f*.

Further, the lock receivers 41*f* may be provided on both sides of a single lock receiver support 41*a*, and the lock receiver support 41*a* may be rotatable about the middle axis thereof. Thus, the lock receiver support 41*a* may be configured such that when it rotates, one lock receiver 41*f* enters a locking position while the other lock receiver 41*f* exits from the locking position.

This U.S. patent application claims priority to Japanese patent application No. 2016-137398 filed on Jul. 12, 2016, the entire contents of which are incorporated by reference herein for correction of incorrect translation.

What is claimed is:

1. A toy top, comprising:

a shaft unit; and a body into which a slot to which a fork of a launcher is to be inserted is formed concentrically with a shaft axis, wherein the body has a lock receiver which is disposed in an end in a longitudinal direction of the slot, and which is to be locked by a locking part of the fork to be inserted into the slot, wherein the toy top is configured such that a spinning force is applied by rotation of the fork of the launcher in a state in which the fork is slid inside the slot toward the end beforehand so that the lock receiver is locked by the locking part at a previously-set locking position, wherein the toy top is launched from the launcher when rotation of the fork is stopped so that the lock receiver is unlocked from the locking part, wherein locking positions are defined respectively at opposite ends in the longitudinal direction of the slot, and wherein the lock receiver is movable to and from the locking positions and is able to selectively enter one of the locking positions.

2. The toy top according to claim 1, wherein the lock receiver is slidable between the opposite ends in the longitudinal direction of the slot.

3. The toy top according to claim 1, wherein a plurality of slots are formed in the body at a predetermined interval in a circumferential direction of the body, and wherein the lock receiver has a plurality of lock receivers which are disposed in the respective plurality of slots.

4. The toy top according to claim 1, wherein an even number of slots is formed such that every one of the slots is opposed to another slot across the shaft axis.

5. The toy top according to claim 1, wherein two slots are formed in the body, and wherein the lock receiver has two lock receivers which are disposed respectively in the two slots and which are coupled to each other by a lock receiver support.

6. The toy top according to claim 1, wherein the shaft unit is disposed under the body, wherein the body has a first hook, the shaft unit has a second hook, and a state of the body and the shaft unit is changeable between a coupled state and a decoupled state according to a relative rotational position about the axis of the shaft unit, in which the first hook is aligned with the second hook in an up-down direction such that an upper face of the first hook is opposed to an under face of the second hook in the coupled state, and the first hook is not aligned with the second hook in the up-down direction in the decoupled state, wherein the state is set from the decoupled state to the coupled state by turning the shaft unit relative to the body in a predetermined rotational direction, and wherein when the spinning toy top is subjected to an impact that rotates the shaft unit relative to the body in an opposite direction to the predetermined rotational direction to change the state to the decoupled state, the body and the shaft are decoupled from each other and disassembled.

7. The toy top according to claim 6, wherein the body and the shaft unit have respective opposing portions that are opposed to each other, and wherein the opposing portions of the body and the shaft unit have a resistance that makes slidable contact between the opposing portions so as to allow stepwise rotation of the shaft unit relative to the body from a first position in the coupled state to a second position in the decoupled state.

* * * * *